US009249560B2

(12) United States Patent
Nillert

(10) Patent No.: US 9,249,560 B2
(45) Date of Patent: Feb. 2, 2016

(54) APPARATUS FOR ACTIVATING OR CLEANING FILTER TUBE WELLS

(75) Inventor: Peter Nillert, Heidesee (DE)

(73) Assignee: Teftorec GmbH, Essen (DE)

( * ) Notice: Subject to any disclaimer, the term of this patent is extended or adjusted under 35 U.S.C. 154(b) by 1113 days.

(21) Appl. No.: 13/266,191

(22) PCT Filed: Apr. 24, 2010

(86) PCT No.: PCT/DE2010/000470

§ 371 (c)(1),
(2), (4) Date: Jan. 6, 2012

(87) PCT Pub. No.: WO2010/124674

PCT Pub. Date: Apr. 11, 2010

(65) Prior Publication Data

US 2012/0097387 A1 Apr. 26, 2012

(30) Foreign Application Priority Data

Apr. 26, 2009 (DE) ..... 10 2009 018 383

(51) Int. Cl.

| | |
|---|---|
| ***E03B 3/15*** | (2006.01) |
| ***E21B 37/00*** | (2006.01) |
| *E03B 3/12* | (2006.01) |
| *E21B 37/08* | (2006.01) |
| *E03B 3/08* | (2006.01) |
| *E03B 3/18* | (2006.01) |

(52) U.S. Cl.

CPC . *E03B 3/15* (2013.01); *E21B 37/00* (2013.01); *E03B 3/08* (2013.01); *E03B 3/12* (2013.01); *E03B 3/18* (2013.01); *E21B 37/08* (2013.01)

(58) Field of Classification Search

CPC ..... E21B 37/08; E21B 37/00; E03B 3/15; E03B 3/18; E03B 3/24; E03B 3/26; E03B 3/08; E03B 3/12

USPC ..... 166/278, 205, 51, 311, 56

See application file for complete search history.

(56) References Cited

U.S. PATENT DOCUMENTS 3,945,436 A 3/1976 Nebolsine

FOREIGN PATENT DOCUMENTS

| | | | |
|---|---|---|---|
| DE | 81 20 151.6 | U1 | 7/1981 |
| DE | 3445316 | A1 | 6/1986 |
| DE | 3844499 | C1 | 7/1990 |
| DE | 40 17 013 | A1 | 11/1991 |
| DE | 202008014113 | * | 2/2009 |
| DE | 20 2008 014 113 | U1 | 3/2009 |
| DE | 10 2007 050 966 | A1 | 4/2009 |

* cited by examiner

*Primary Examiner* — Jennifer H Gay
*Assistant Examiner* — George Gray
(74) *Attorney, Agent, or Firm* — Muncy, Geissler, Olds & Lowe, P.C.

(57) ABSTRACT

An apparatus for activating or cleaning filter tube wells with a filter tube includes a first and second volume bodies, which are substantially adapted to the inside diameter of the filter tube and on the outer circumferential surfaces thereof are designed radially flexibly with respect to the well longitudinal axis such that a sealing effect is achieved between the outer circumferential surfaces of the respective volume bodies and the inside wall of the filter tube. A removal chamber, which can be hydraulically connected to a pump device, is formed between the first and second volume bodies and the inside wall of the filter tube. At least one equalizing tube completely penetrates the removal chamber in the longitudinal direction of the apparatus such that a hydraulic connection is established between the respective regions that adjoin the outer faces of the two volume bodies disposed opposite of the removal chamber.

23 Claims, 11 Drawing Sheets

APPARATUS FOR ACTIVATING OR CLEANING FILTER TUBE WELLS

This application is a national stage of International Application No.: PCT/DE2010/000470, which was filed on Apr. 24, 2010, and which claims priority to German Patent Application No.: DE 10 2009 018 383.3, which was filed in Germany on Apr. 26, 2009, and which claims priority to U.S. Provisional Application No. 61/258,446, which was filed on Nov. 5, 2009, and which are all herein incorporated by reference.

The invention relates to an apparatus for activating or cleaning filter tube wells.

In producing filter columns in the earth for the purpose of transporting ground water, it is necessary, once the well superstructure has been completed, to extract contaminants from the filter gravel introduced into an annular chamber between the filter space and edge of the bore hole and from the bore hole edge itself, as well as to extract sand grains of small diameter which may be removed through suffosion. The removal of such contaminants or particles is referred to as activation. The goal of activating a well is to create the smallest possible pore space in the annular filter chamber and adjacent earth in order to achieve the lowest possible flow resistance for the ground water entering the well and so that the resulting decrease in ground water pressure head on and within the well is minimized. During activation, coarse clay, fine sand and other small mineral or organic particles that may be transported along with the flowing ground water through the pores of the support particle structures at a correspondingly high rate should also be introduced from the adjacent soil layers into the well and thus pumped out.

Well reclamation includes all measures used to remove mineral and/or organic deposits that occur during the well operating time from the well annular chamber and adjacent rock. The methods used for this purpose follow the principle of separating or detaching deposits and buildup on the filter material and support particle structure of the adjacent rock and removing these particles through the well filter. A variety of methods and apparatuses are known for separation and detachment which make use of hydromechanical, hydropneumatic and chemical principles.

To remove deposited and/or detached particles from the annular chamber of a well and the adjacent rock, it is necessary to produce the highest possible flow velocities in the area to be cleaned. Known methods and apparatuses used therefor reduce the well filter to be treated to a working section by introducing a working chamber provided with seals at its ends into the filter tube. According to the prior art, a working chamber of this type is described in German Utility Model 81 20 151, wherein a so-called working chamber is provided between two blocking bodies, which are situated at a distance from each other and above each other, and an inner wall of the filter tube. A flow, whose rate is 5 to 10 times higher than the flow rate over this subsection of the well filter during normal well operation, is pumped through this working chamber, whose height and length relative to the total length of the filter tube are comparatively short. Due to the so-called permeability contrast, according to which the water permeability in the gravel heap within the annular filter chamber is greater than that of the adjacent rock, the increased flow has only a slight effect on the flow velocity within the annular chamber and the adjacent rock. In addition, the flow always enters the annular chamber radially from the surrounding rock over the entire length of the filter tube. The ground water enters the filter tube above and below the working chamber and flows within the annular chamber and, in particular, within the filter tube in the direction of the working chamber, the ground water flowing within the filter tube flowing around the side of the blocking bodies in order to enter the working chamber. The flowing portion of the well water is reduced thereby on the side or radially adjacent to the working chamber in the annular chamber area, and its flow velocity is reduced, which has a disadvantageous effect on cleaning quality.

Known removal chambers for intensive de-sanding are described in DVGW Data Sheet W 119. A sufficient radial flow into the chamber opening is assumed with respect to these removal chambers. To geometrically limit the chamber opening in the filter tube, sealing bodies which are designed either as sealing washers or as variable-volume (inflatable) annular tubes are needed at the ends thereof. No importance is attached to a longitudinal extension of these sealing bodies or their length in relation to the length of the open chamber. Instead, only the sealing effect of these sealing bodies within the filter tube for delimiting the working or removal chambers is deemed important with regard to these sealing bodies.

Conventional apparatuses for cleaning wells, for example, apparatuses according to DE 81 20 151, have the disadvantage that the cleaning performance in the annular chamber and, in particular, in the adjacent rock is not optimal, even at a considerably elevated flow rate. Other known apparatuses, for example those according to DE 40 17 013 C2 or also DE 38 44 499 C1, are used to clean a gravel backfill and the adjacent rock in the radial environment of a tube well, a circulation flow being produced between multiple chambers by using pumps and chambers that are delimited from each other. The purpose of this is to cause a rinsing of the pore space in the filter gravel and adjacent rock between the chambers delimited in the well filter tube, in order to thereby detach contaminants and deposits adhering to the grains of gravel. If necessary, this may be accompanied by the addition of chemical cleaning agents.

DE 20 2008 014 113 U1 shows an apparatus according to the definition of the species for activating or cleaning filter tube wells which have a filter tube. An apparatus of this type comprises an first and a second volume body which are largely adapted to the inner diameter of the filter tube by their outer diameters and whose outer circumferential surfaces are designed to be flexible in the radial direction with respect to the well longitudinal axis, such that a sealing effect exists between the outer circumferential surfaces of the respective volume bodies and the inner wall of the filter tube. A removal chamber, which may be hydraulically connected to a pump device, is provided between the first and second volume bodies and the inner wall of the filter tube. A disadvantage of this apparatus is that the pumping of well water loses efficiency in the event of an uneven radial flow into the apparatus along its longitudinal axis.

In all removal chambers of known apparatuses, a problem arises from the fact that the chamber flow rate is not always automatically divided into two equal portions $Q_o$ and $Q_u$ as well as a smaller radially inflowing portion $Q_r$, regardless of the type of sealing bodies used to limit them. The division of the chamber flow rate of only the radially inflowing portion $Q_r$ into two equal portions $Q_o=Q_u$ occurs approximately automatically only if the removal chamber is located exactly in the middle of a well filter and, in addition, if the filter is located in the middle of a hydraulically cohesively acting ground water conducting layer of approximately uniform permeability. A situation of this type is shown in FIG. 1. However, it should be noted that this situation is extremely rare or practically never occurs at all. In principle, it must be assumed that natural ground water conductors are always layered as a result of their geohistorical origins and are consequently characterized in layers by different degrees of permeability. The length of well filters is regularly selected as a function of how this length is technically required for withdrawing the desired amount of water. These filter lengths are then suitably situated in the area of the most permeable layers of the well. Consequently, only part of a ground water conductor through which ground water flows in a hydraulically cohesive manner is constructed as a well filter, the remaining part of the ground water conductor remaining unconstructed. When ground water is removed through a well filter of this type, which is also referred to as being "incompletely constructed," the flow enters the filter at different intensities over its longitudinal extension. If a removal chamber is located in the middle of this filter, the removal chamber separating the water flow entering the upper section of the well filter from the water flow entering the lower section, and these partial flows being combined only after they flow around the chamber limiting elements, it goes without saying that these partial flows $Q_o$ and $Q_u$ are always different from each other, due to the asymmetry of the flow spaces and also the different permeabilities in the rock. This situation is shown in FIG. 2. This variability between partial flows $Q_o$ and $Q_u$ may assume extreme values such that one of each of the two partial flows assumes a situation-specific maximum value and the other partial flow approaches the value zero.

The object of the invention is therefore to provide an apparatus for activating or cleaning filter tube wells, in which an automatic control of volumetric flows above and below a removal chamber is carried out in order to thereby achieve a uniformly intensive activation or cleaning effect.

This object is achieved by an apparatus having the features of Claim 1. Advantageous refinements of the invention are defined in the dependent claims.

An apparatus according to the invention for activating or cleaning filter tube wells that have a filter tube comprises a first and a second volume body, which are largely adapted to the inner diameter of the filter tube by their outer diameters and whose outer circumferential surfaces have a flexible design radially with respect to the well longitudinal axis, such that a sealing effect is achieved between the outer circumferential surfaces of the respective volume bodies and the inner wall of the filter tube. A removal chamber, which may be hydraulically connected to a pump device, is provided between the first and second volume bodies and the inner wall of the filter tube. The apparatus has at least one equalizing tube which completely penetrates the removal chamber in the longitudinal direction of the apparatus, such that a hydraulic connection is established between the areas which each adjoin the outer end faces of the two volume bodies opposite the removal chamber. With the aid of the equalizing tube, a water volumetric flow that flows over a volume body situated in the filter tube of the well, distributed to an area of the filter tube downstream from the other, opposite volumetric body over which the flow passes, if necessary at a lower water volumetric flow. If, in extreme cases, the flow over this volume body approaches the value zero as a result of the position of a volume body on an impermeable delimiting layer of the ground water conductor, the water volumetric flow by means of which the flow passes against the other, opposite volume body is largely cut in half due to the fact that the equalizing tube hydraulically interconnects the outer end faces of the two volume bodies opposite the removal chamber in order to equalize the flow. In other words, the equalizing tube automatically equalizes the pressure or volumetric flow between the areas of the filter tube above and below the apparatus in the event of an uneven flow into the apparatus, the partial flows above and below the first/second volume body assuming approximately the same value.

The use of the apparatus according to the invention, which has the aforementioned equalizing tube, for cleaning the pores of the particle mixture surrounding a filter tube guarantees a nearly uniformly intensive cleaning effect of the two chamber limiting members in each working position of the apparatus within the filter and in each filter tube which is situated in any manner within the ground water conductor, in that the equalizing tube carries out an automatic suction flow control between the areas adjacent to the outer end faces of the two volume bodies. Without any further measures, an automatic suction flow control of this type ensures that the partial flows which flow around the two chamber limiting members in the form of the volume bodies vertically in the filter gravel annular chamber are always approximately the same size. In other words, the total amount of water available for these two partial flows in the well filter tube is distributed in approximately the same manner to the two partial flows $Q_o$ and $Q_u$ in every operating situation of the apparatus.

According to an advantageous refinement of the invention, a transport line may empty into the removal chamber, it being possible to connect this transport line to the pump device. The pump device generates a low pressure in the transport line such that water is removed from the removal chamber and transported above ground through the transport line. The pump device, together with the transport line, thus ensures that water is removed from the removal chamber of the apparatus.

In an advantageous refinement of the invention, the transport line may penetrate the first volume body such that the first volume body surrounds the transport line. This has the advantage of a particularly space-saving arrangement of the transport line within the first volume body. Moreover, the transport line is shielded radially to the outside by the first volume body relative to the filter tube, so that any damage or the like is prevented.

The equalizing tube, which completely penetrates the removal chamber in the longitudinal direction of the apparatus, in addition to the pressure equalization mentioned above during operation of the apparatus, results in the further advantage that the apparatus may be inserted into the filter tube of the filter tube well more easily and with less resistance before the apparatus is placed into operation. As a result of the hydraulic connection between the areas adjacent to the two outer end faces of the two volume bodies, the apparatus does not move or shift against a water resistance within the filter tube but rather only against a friction resistance which results from contact between the outer circumferential surfaces of the two volume bodies and the filter tube. Due to the passage of the equalizing tube, no piston function of the apparatus actually occurs within the filter tube, which substantially reduces the water resistance during shifting of the apparatus.

In an advantageous refinement of the invention, the first volume body may be open on its outer end face opposite the removal chamber. The same applies to the second volume body, which may be open on its outer end face opposite the removal chamber. The construction of the apparatus and the manufacture of the two volume bodies are simplified and made more economical thereby.

In an advantageous refinement of the invention, the equalizing tube may pass within the first volume body and end at a distance from the open end face of the first volume body, such that the first volume body forms a kind of collecting basin from its open end face to the opening in the equalizing tube. As a result, dirt particles that enter the filter tube through slits therein and fall onto the first volume body in a vertical well are not deposited onto the upper end face of the volume body, but are instead received by the collecting basin, which effectively prevents the aforementioned dirt particles or the like from entering the limiting layer between the outer circumferential surface of the first volume body and the inner wall of the filter tube, which would disadvantageously increase the friction resistance if the apparatus shifts within the filter tube. Alternatively, the equalizing tube may empty into an end plate of the first volume body which adjoins the removal chamber, such that the first volume body forms a collecting basin largely along its entire length. In addition to reducing the weight, this has the advantage that the volume of this collecting basin is increased, which makes it possible to accommodate a larger number of dirt particles or the like therein. A longer operating period of the apparatus within the filter tube well is therefore possible without the danger of dirt particles penetrating the limiting area between outer circumferential surface of the first volume body and the inner wall of the filter tube. The collecting basin—regardless of its design—is suitably emptied when the apparatus is removed from the filter tube well and brought to the surface for maintenance purposes or the like. Emptying this collecting basin is additionally ensured by the equalizing tube, in that the solids or dirt particles deposited therein are transported downward into the well sump through the removal chamber via the equalizing tube. If the open cross-sectional area of the equalizing tube occupies a relatively large portion of the bottom area of the collecting basin or the end plate of the first volume body, which adjoins the removal chamber, no particular conducting apparatuses are needed to transport the collected solid particles into the equalizing tube.

According to an advantageous refinement of the invention, the transport line may be held by radial supporting ribs within the first volume body. This produces a continuously equal distance between the transport line and the wall of the first volume body and thus effectively prevents damage to the apparatus and the well filter tube.

In an advantageous refinement of the invention, the equalizing tube may empty into a end plate of the second volume body which adjoins the removal chamber. This has the advantage that the equalizing tube has a comparatively short length. This applies, in particular, to the case that the equalizing tube empties into the relevant end plates of the two volume bodies adjoining the removal chamber.

In an advantageous refinement of the invention, a plurality of equalizing tubes may be provided which completely penetrate the removal chamber in the longitudinal direction of the apparatus. Such a plurality of equalizing tubes makes it possible to achieve a greater or more efficient equalization of volumetric flow between the areas adjoining the outer end faces of the two volume bodies. A flow equalization of this type is further improved by the fact that the equalizing tubes, including their inner circumferential surfaces, are designed to be as hydraulically smooth as possible. In addition, the number and diameter of the equalizing tubes are suitably selected in such a way that a sufficiently large flow cross-section remains between the equalizing tubes in the cylindrical space of the central chamber opening, this flow cross-section permitting the water entering the chamber opening via the well filter tube to be delivered unobstructed to the transport line. A distance of the outer surfaces from adjacent equalizing tubes suitably corresponds to at least one slit width of the filter tube and, in particular, to twice the slit width of the filter tube. This ensures that the solid particles that enter the removal chamber through the slits in the filter tube may also be removed via the transport line without problems. The removal of solid particles through the transport line is further improved by the fact that a minimum free flow cross-section between the equalizing tubes radially to the longitudinal axis of the apparatus correspond at least to a cross-section of the transport line. As a result, this prevents solid particles from becoming stuck between the equalizing tubes and the removal chamber from becoming clogged between the respective equalizing tubes.

In an advantageous refinement of the invention, the equalizing tubes are situated around the centric middle of the removal chamber, this middle of the removal chamber remaining free. A coaxial arrangement of the transport line within the first volume body with respect to the centric middle of the removal chamber ensures that a low pressure applied to the transport line is transmitted to the removal chamber without losses in order to ensure the removal of well water.

In an advantageous embodiment of the invention, the distance of the two volume bodies relative to each other may be adjusted such that a height of the removal chamber in the direction of the longitudinal axis of the apparatus may be set or changed. This is suitably accomplished by the fact that the first volume body and/or the second volume body may be shifted with respect to the equalizing tube. Suitable clamping devices or the like ensure that the first or second volume body returns to a predetermined and locked position with respect to the equalizing tube after it is shifted with respect to the equalizing tube. During operation of the apparatus, this ensures that a selected distance of the two volume bodies relative to each other and the height of the removal chamber are not adjusted automatically.

It is understood that the aforementioned features and the features still to be explained below may be used not only in the combinations indicated but also in other combinations or alone without going beyond the scope of the present invention.

The invention is illustrated schematically below in the drawing on the basis of multiple specific embodiments and described in detail with reference to the drawing, where:

Figure 1:
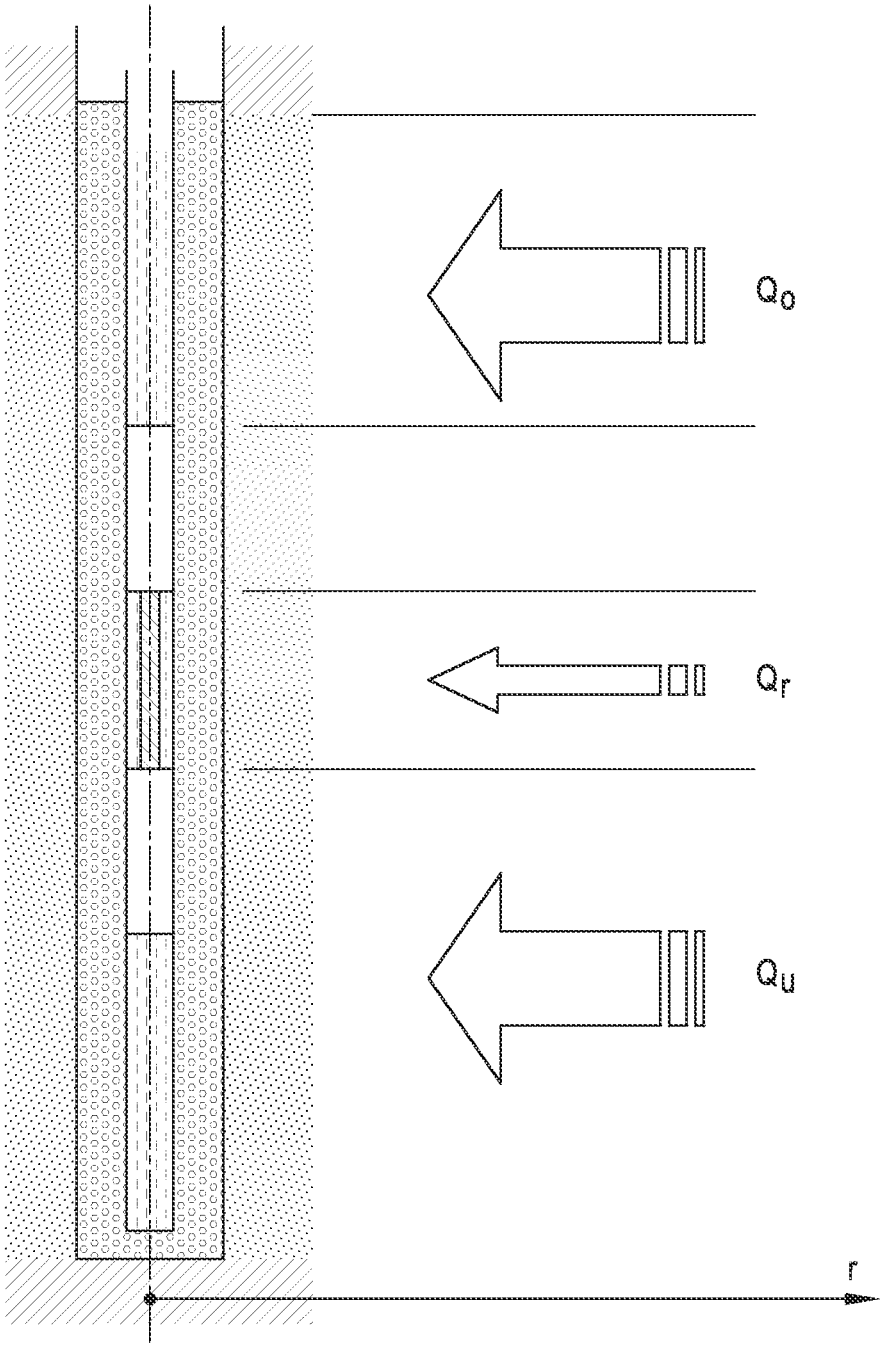
FIG. 1 shows flow conditions for a conventional cleaning apparatus under idealized conditions of a filter tube well.
Figure 2:
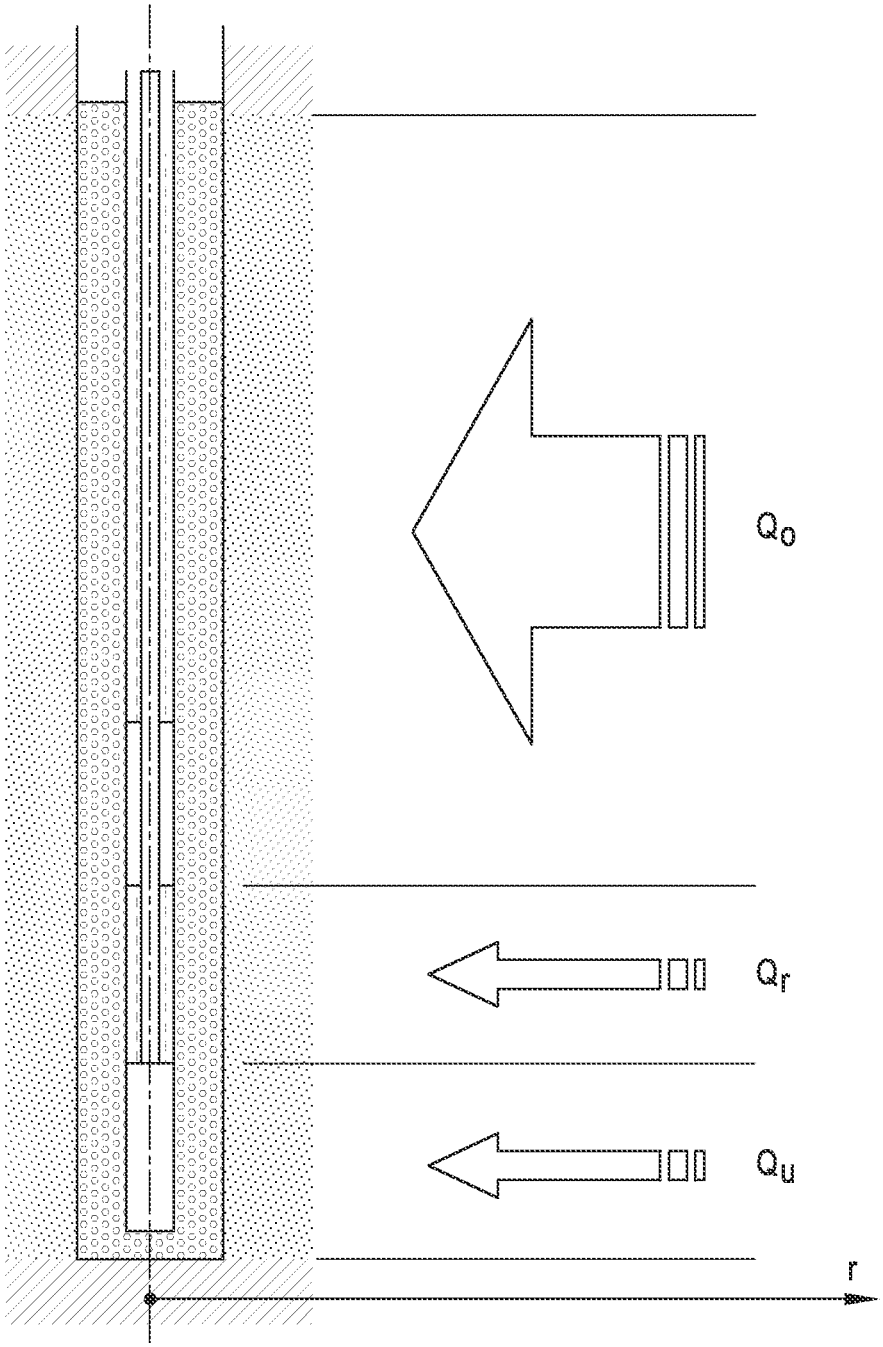
FIG. 2 shows the apparatus from FIG. 1 under actual conditions of a filter tube well which result in uneven flow conditions.
Figure 3:
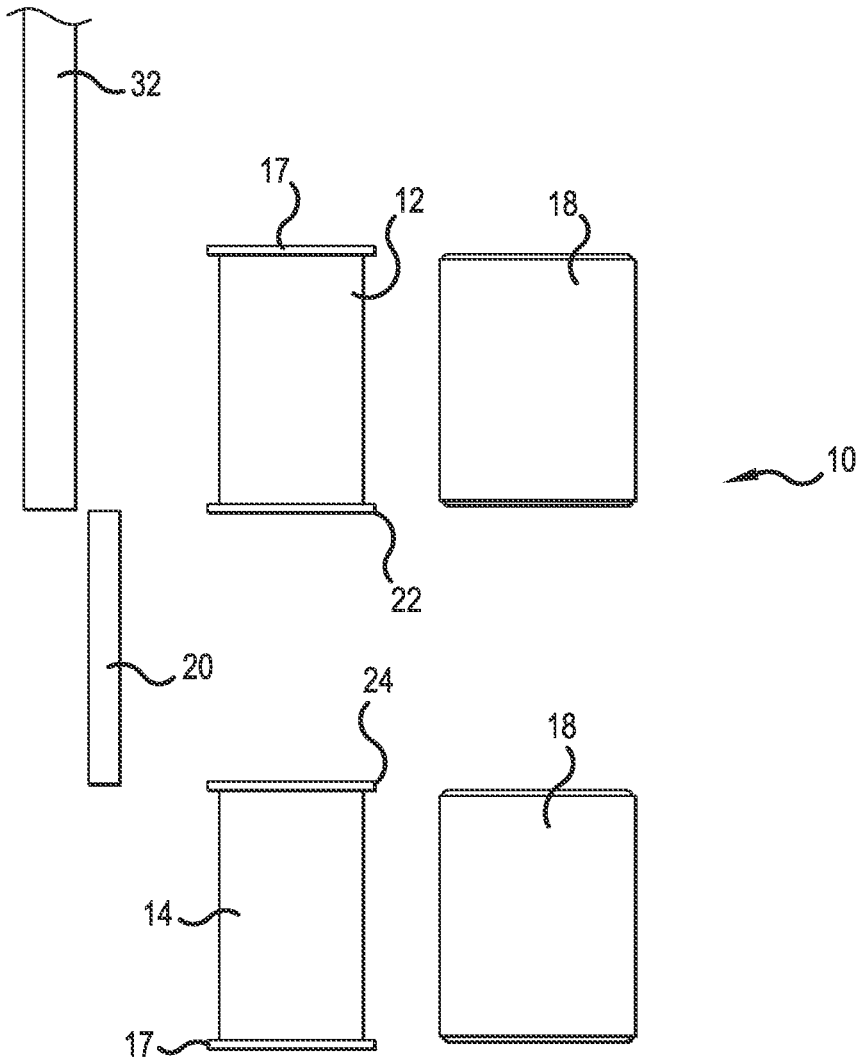
FIG. 3 shows an exploded side view of an apparatus according to the invention.
Figure 5:
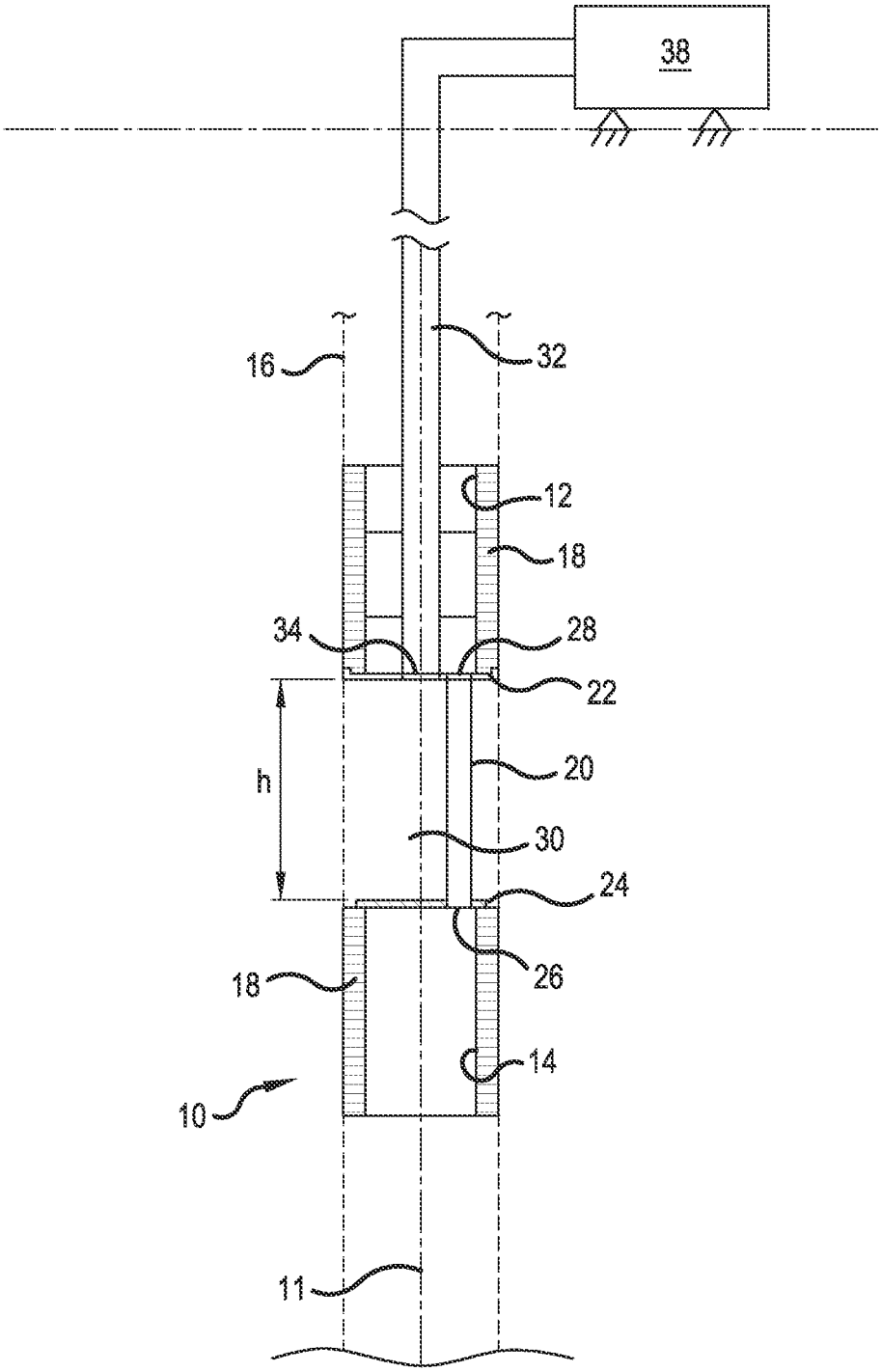
FIG. 5 shows a side view of the apparatus from FIG. 3 or from FIG. 4 in the mounted state.

FIGS. 3 and 5 show the principal structure of apparatus 10 according to the invention. FIG. 3 shows an exploded side view of apparatus 10, including its main components. Apparatus 10 comprises a first volume body 12 and a second volume body 14. With regard to a filter tube 16 (FIG. 5) of a filter tube well, the two volume bodies 12, 14 perform the function of a sealing piston and are always referred to as such below. Sealing pistons 12, 14 are each suitably formed from one largely rigid, cylindrical body. Each of the two sealing pistons 12, 14 has an annular disk 17 on its outer end face. A jacket-shaped, flexible layer 18, which is made of an open-celled foam rubber, is situated on each of the two sealing pistons 12, 14. Flexible layer 18 is held firmly in place on the two sealing pistons by annular disk 17. The outer diameter of the two sealing pistons 12, 14 is largely adapted to an inner diameter of filter tube 16. The outer diameter of flexible layer 18 is dimensioned to be slightly larger than the inner diameter of filter tube 16. The functionality of flexible layer 18 is explained in further detail below.

Figure 4:
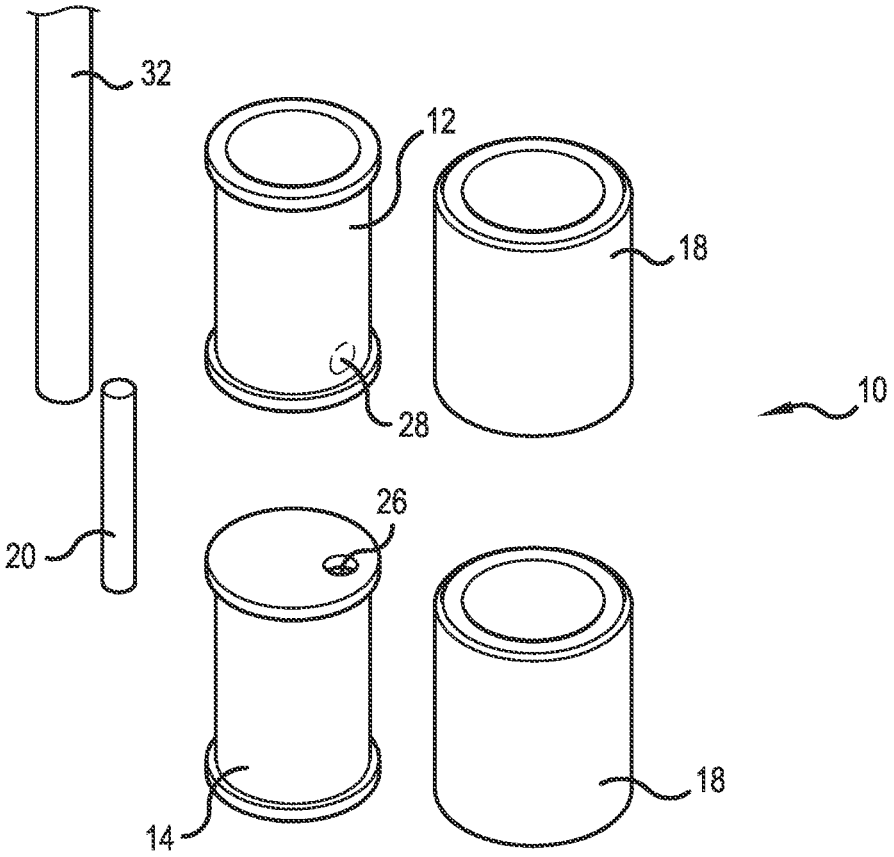
FIG. 4 shows an exploded perspective view of the apparatus from FIG. 3.

Apparatus 10 also comprises at least one equalizing tube 20, which is attached to opposite end plates 22, 24 of the two sealing pistons 12, 14 or empties into these end plates. For this purpose, end plate 24 of second sealing piston 14 has an opening 26 (FIG. 4) to which a free end of equalizing tube 20 is connected. In the same manner, end plate 22 of first sealing piston 12 has an opening 28 (FIG. 5) to which the opposite free end of equalizing tube 20 is connected.

FIG. 5 shows a side cross-sectional view of apparatus 10 in the mounted state when both sealing pistons 12, 14 are attached to equalizing tube 20. Apparatus 10 is used for insertion into a filter tube 16 of a filter tube well in order to suitably clean and/or activate the filter tube well. In FIG. 5, a filter tube of this type is indicated in simplified form by broken lines and identified by reference numeral 16. It is apparent that a so-called removal chamber 30, which is limited by an inner wall of filter tube 16, is provided between the two sealing pistons 12, 14. A height of this removal chamber correspond to a distance between the two sealing pistons 12, 14 and their opposite end plates 22, 24 and is identified by h.

In FIG. 5, apparatus 10 is shown in a state in which it is completely inserted into filter tube 16. Flexible layers 18, which are attached to the outside of the two sealing pistons 12, 14, have an outer diameter which is slightly smaller than the inner diameter of filter tube 16, as explained above. When apparatus 10 is inserted into filter tube 16, flexible layers 18 are slightly compressed radially with regard to well longitudinal axis 11, a result of their flexible characteristic, so that they cling tightly to the inner wall of filter tube 16. In contact with well water, the pores of flexible layers 18 fill such that a sufficient sealing effect is achieved between an outer circumferential surface of both sealing pistons 12, 14 and the inner wall of filter tube 16.

Apparatus 10 comprises a transport line 32, which penetrates first sealing piston 12 along its longitudinal axis and empties into an opening 34 which is provided in end plate 22 of first sealing piston 12. Transport line 32 is held within first sealing piston 12 by supporting ribs 36 (FIG. 5) which run in the radial direction. Transport line 32 passes through the entire filter tube 16 and is suitably hydraulically connected to a pump device 38. During operation of this pump device 38, a low pressure is generated within transport line 32. Due to the fact that transport line 32 empties into end plate 22 of first sealing piston 12, and thus also into removal chamber 30, as explained above, this low pressure is also transmitted to removal chamber 30, so that well water may be transported accordingly from removal chamber 30 and through transport line 32. Pump device 38 is able to operate according to different delivery principles and be situated either above ground (as shown in FIG. 5) or in the well.

Both first sealing piston 12 and second sealing piston 14 are designed to be open at their outer end faces, each of which is opposite removal chamber 30. As a result, a hydraulic connection is established between the areas by means of equalizing tube 20, which completely penetrates removal chamber 30 and whose two ends empty into a corresponding end plate of first and second sealing pistons 12, 14, the areas each emptying at the outer end faces of the two sealing pistons 12, 14. A water volumetric flow may thus pass from the open end face of first sealing piston 12, through equalizing tube 20, to the open end face of second sealing piston 14, and vice versa.

The specific embodiment of apparatus 10 according to the invention and illustrated in FIG. 5 is shown in simplified form in such a way that only one equalizing tube 20 is present. A plurality of equalizing tubes 20 may also be provided, which run parallel to each other and which penetrate removal chamber 30 along longitudinal axis 11 of apparatus 10 in order to establish a hydraulic connection between the outer end faces of the two sealing pistons 12, 14. In the event of a plurality of equalizing tubes, it is understood that these equalizing tubes empty into respective openings which are provided in end plates 22, 24.

Figure 6A:
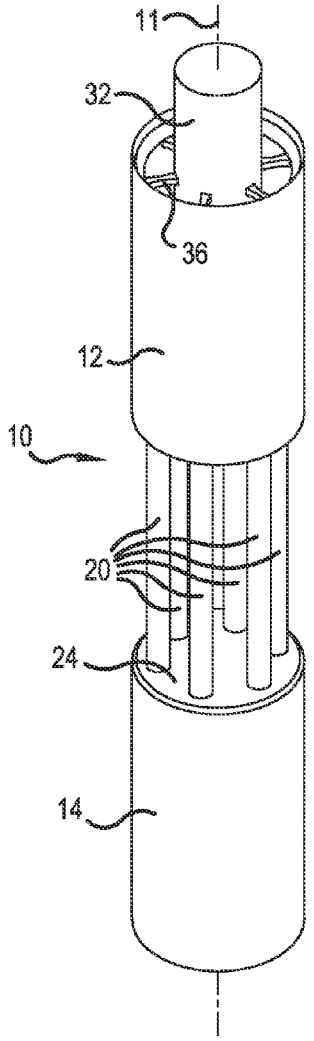
FIG. 6A shows a perspective view of an apparatus according to the invention, seen diagonally from above.
Figure 6B:
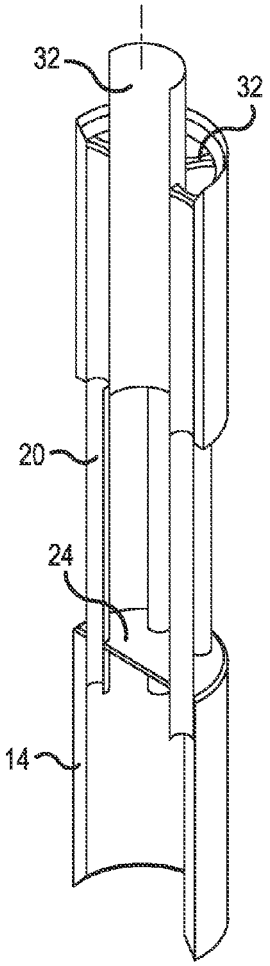
FIG. 6B shows the apparatus from FIG. 6A in a cutaway representation.
Figure 6C:
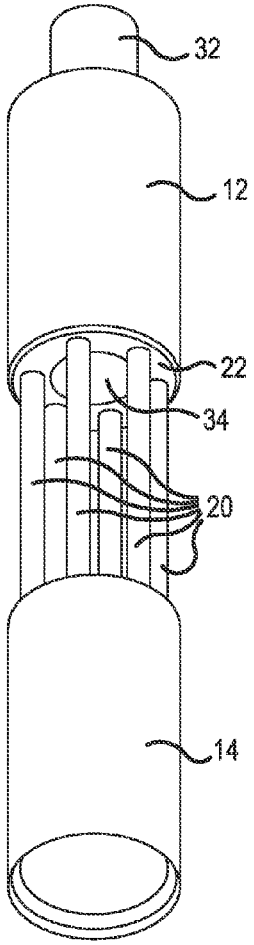
FIG. 6C shows a perspective view of the apparatus from FIG. 6A, seen diagonally from below.

A specific embodiment of apparatus 10 according to the invention, which has a plurality of equalizing tubes 20, is illustrated in FIGS. 6A, 6B and 6C. FIG. 6A shows a perspective view of this specific embodiment, seen diagonally from above. It is clearly apparent that first sealing piston 12 is designed to be open at its upper end face. Transport line 32 is held within first sealing piston 12 by the plurality of radially running supporting ribs 36 and runs in the longitudinal direction or parallel to longitudinal axis 11 of apparatus 10. A total of six equalizing tubes 20 penetrate removal chamber 30 between the two sealing pistons 12, 14. In FIG. 6B, which shows a semi-sectional view of the apparatus from FIG. 6A along longitudinal axis 11, it is clear that equalizing tubes 20 each empty into sealing pistons 12, 14 in the area of their end plates 22, 24. Due to the fact that sealing pistons 12, 14 are designed as cylindrical hollow bodies, equalizing tubes 20 ensure a hydraulic connection of the areas which each adjoin the open, outer end faces of the two sealing pistons. Finally, FIG. 6C shows a perspective view of the apparatus from FIG. 6A, seen from below, it being apparent that second sealing piston 14 is designed to be open at its outer end face.

The use of apparatus 10 within a filter tube well or its filter tube 16 and the resulting flow conditions are explained in detail below with reference to FIG. 7. For the purpose of simplification, FIG. 7 shows only a semi-sectional view of apparatus 10 along its longitudinal access 11.

Figure 7:
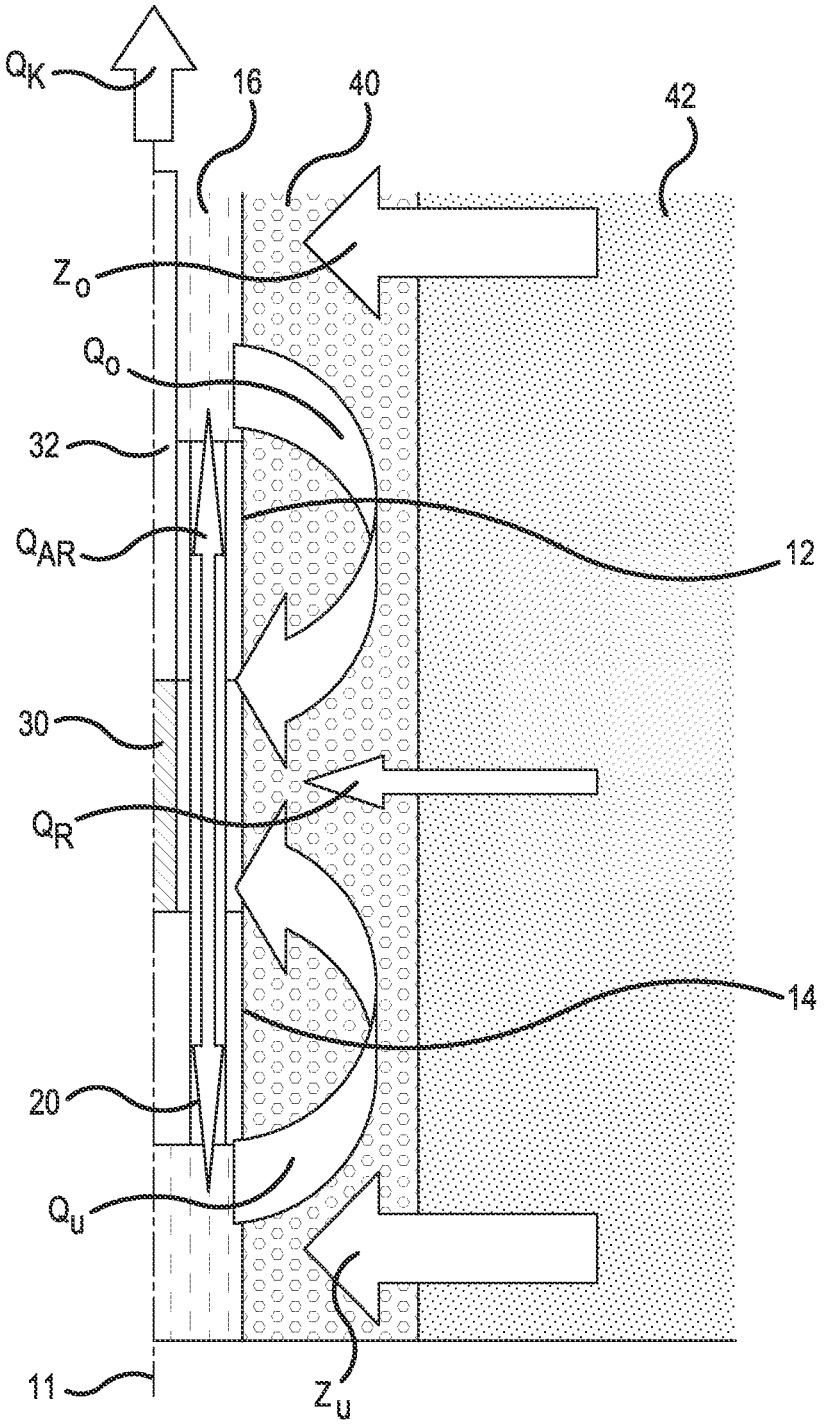
FIG. 7 shows a side sectional view of an apparatus according to the invention, portions of the flow in a filter tube well being illustrated.

In the representation in FIG. 7, apparatus 10 is completely introduced into a filter tube well or its filter tube 16. Filter tube 16 is surrounded by an annular chamber 40 which is filled with a gravel heap. Annular chamber 40, in turn, is surrounded by adjacent rock 42. A water volume $Z_u$ flows into apparatus from rock 42 above first sealing piston 12. The same applies to an area below second sealing piston 14, into which a water volume $Z_o$ flows from rock 42. An equalizing flow $Q_{AR}$ is produced within apparatus 10 along its longitudinal axis 11 with the aid of equalizing tubes 20. An equalizing flow $Q_{AR}$ of this type penetrates equalizing tubes 20 and also the two sealing pistons 12, 14, which are designed as hollow cylinders, and thereby establishes a hydraulic connection between the areas adjoining the outer, open end faces of sealing pistons 12, 14.

A flow passes around sealing pistons 12, 14, starting from the areas adjoining their outer end faces, along their longitudinal axis in the direction of removal chamber 30, this surrounding flow penetrating the layer of filter gravel within annular chamber 40 and being identified by $Q_o$ and $Q_u$, respectively, in FIG. 7. Surrounding flow $Q_o$ and $Q_u$ along sealing pistons 12, 14 takes place because flexible layer 18 on the outer circumferential surfaces of sealing pistons 12, 14 produces a sealing effect toward an inner wall of filter tube 16. The hydraulic connection explained above, with the aid of equalizing tubes 20, causes flow portions $Q_o$ (for flowing around upper first sealing piston 12) and $Q_u$ (for flowing around lower second sealing piston 14) to assume approximately the same values. This is the case, in particular, when different flow resistances prevail in the ground water conductor in the area of rock 42 above and below removal chamber 30, due to an irregular rock composition, so that water volume flows $Z_o$ and $Z_u$ are of different sizes.

Surrounding flows $Q_o$ and $Q_u$ enter removal chamber 30 after flowing past the two sealing pistons 12, 14. In addition, a direct radial inflow $Q_r$ enters the removal chamber from rock 42 through annular chamber 40. With the aid of a low pressure applied to transport line 32, a removal flow $Q_k$ (FIG. 7) is removed from removal chamber 30 and transported above ground.

Equalizing tubes 20 perform an automatic suction current control, after which water volumetric flows $Z_o$ and $Z_u$ of different sizes, which may flow into apparatus 10 above and below the two sealing pistons 12, 14, are divided into surrounding flows $Q_o$ and $Q_u$ of equal size, which enter removal chamber 30 through annular chamber 40 along the two sealing pistons. This guarantees an almost uniformly intensive cleaning effect in the area of the two sealing pistons. The total volume of water available in the well filter tube is thus distributed approximately uniformly to the two partial flows in the form of surrounding flows $Q_o$ and $Q_u$ in every operating situation and, in particular, without additional measures.

During operation of apparatus 10 it is possible for solid particles to be introduced together with the ground water through the slits in filter tube 16. Such solids drop down into the well sump below apparatus 10. i.e., below second sealing piston 14, and may be removed without problems at a later point in time. Solid particles that are introduced into filter tube 16 above apparatus 10 drop from above in the direction of first sealing piston 12. Since sealing piston 12 is open at its outer end face, the introduced solids enter the interior of first sealing piston 12, from where they are transported to the well sump through the at least one equalizing tube 20. Since the cross-sectional areas of the equalizing tubes account for a relatively large portion of the cross-section of the sealing pistons, no special conducting apparatuses are needed to transport the entering solid particles to the equalizing tubes and thus to the well sump. Due to the conduction of the solid particles through equalizing tubes 20 and down into the well sump, these solid particles advantageously do not impair the operation of apparatus 10 and, for example, an axial shifting of apparatus 10 within filter tube 16.

Equalizing tubes 20 and the associated hydraulic connection between the outer open end faces of the two sealing pistons 12, 14 result in the further advantage that apparatus 10 may be introduced into filter tube 16 of the filter tube well at little resistance. As a result of the hydraulic connection, namely, no piston function of the lower second sealing piston 15 occurs within filter tube 16, so that less or no water is displaced when apparatus 10 shifts within filter tube 16. The same is true with respect to upper first sealing piston 12 during upward axial shifting of apparatus 10 within filter tube 16 when apparatus 10 is completely introduced into the filter tube well. Apparatus 10 within filter tube 16 thus does not move against a water resistance but primarily only against a friction resistance, which results from contact with flexible layer 18 and the inner wall of filter tube 16.

With regard to the representation FIG. 7, it is understood that illustrated water volume flows $Z_o$ and $Z_u$ are shown to be largely equal only for the purpose of simplification. In practice, these water volumetric flows $Z_o$ and $Z_u$ will usually assume different values, due to different resistances within the ground water conductor in the form of rock 42, so that, as explained above, a pressure or flow equalization is achieved via equalizing tubes 20. Depending on the prevailing conditions within the ground water conductor, an equalizing flow through equalizing tubes 20 is achieved in the upward or downward direction.

Figure 8:
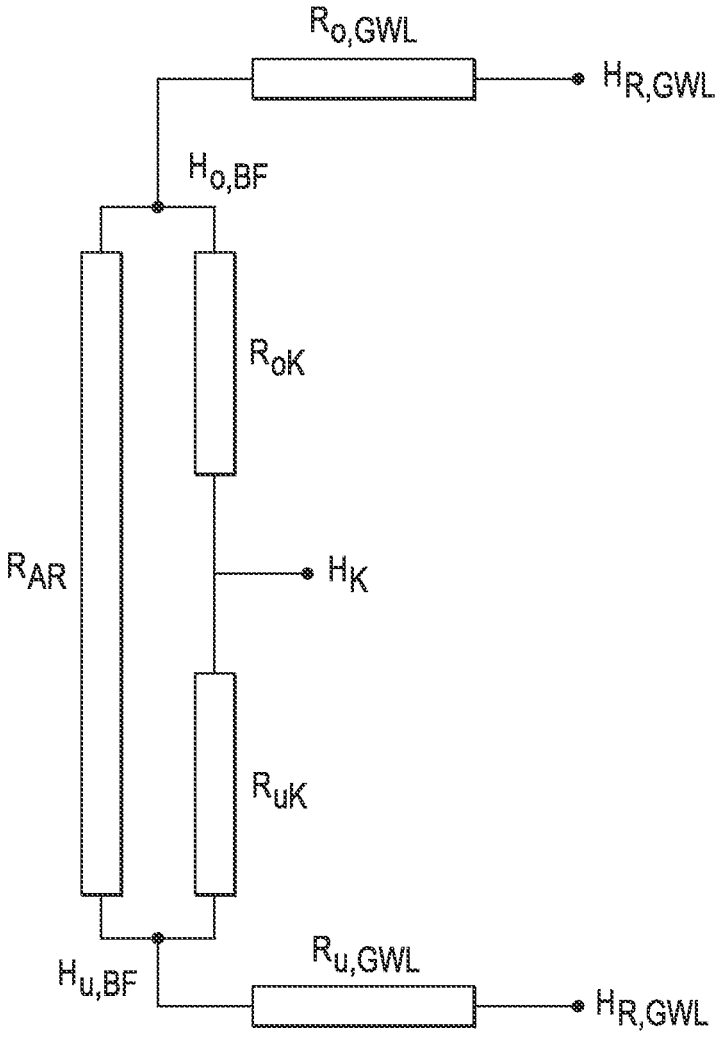
FIG. 8 shows an equivalent circuit diagram of the apparatus according to the invention from FIG. 7 for illustrating hydraulic resistances.

FIG. 8 shows a schematic equivalent circuit diagram of the main hydraulic resistances from FIG. 7 and is used to provide a better understanding to the flow conditions according to FIG. 7. In FIG. 8, the pressure head in the ground water conductor in the form of rock 42, at a greater distance to apparatus 10 (for example, at a radial distance of 1.5 to 2 times the power of the ground water conductor) from the well, is identified by $H_{R,GWL}$ and represents the greatest pressure potential to be assumed for the well inflow. The suction effect of pump device 38 is identified by $H_K$ and describes the lowest pressure potential in the area of removal chamber 30. $H_{o,\ BF}$ and $H_{u,\ BF}$ each identify the pressure potentials at the upper and lower ends of apparatus 10, i.e., adjacent to the outer end faces of respective sealing pistons 12, 14. The inflow resistances in the ground water conductor above and below the removal chamber are identified by $R_{o,\ GWL}$ and $R_{u,\ GWL}$, respectively. The flow resistances for the flow around sealing pistons 12, 14 along longitudinal axis 11 are identified by $R_{oK}$ (with respect to upper first sealing piston 12) and $R_{uK}$ (with respect to lower second sealing piston 14), respectively. The total hydraulic resistance over the length of apparatus 10 is identified by $R_{AR}$ and represents the actual resistance of equalizing tubes 20.

If $R_{u,\ GWL}$ is greater than $R_{o,\ GWL}$, $H_{u,\ BF}$ will initially be less than $H_{o,\ BF}$, and an equalizing flow will ensue over equalizing tubes 20 at hydraulic resistance $R_{AR}$ from top to bottom, i.e., from first sealing piston 12 in the direction of second sealing piston 14. If $R_{o,\ GWL}$ is greater than $R_{u,\ GWL}$, due to the specific asymmetry of the flow into removal chamber 30, an equalizing flow above $R_{AR}$ takes place through equalizing tubes 20 from bottom to top. It is understood that the optimum equalizing flow over equalizing tubes 20 takes place at lowest hydraulic resistance $R_{AR}$. Actual resistance $R_{AR}$ of equalizing tubes 20 consequently always causes a remaining slight difference between the flows around the pistons, and the absolute variable of this difference also depends on the actual asymmetry of the inflow in the form of water volumetric flows $Z_o$, $Z_u$. The flow resistance of equalizing tubes 20 may be minimized by the fact that their inner surfaces are designed to be as hydraulically smooth as possible. The number and diameter of equalizing tubes 20 must be suitably selected, taking into account the required withdrawal flow $Q_K$ that is removed from removal chamber 30 through transport line 32.

With regard to the arrangement of a plurality of equalizing tubes 20 within removal chamber 30, it should be noted that the minimum free flow cross-section between the equalizing tubes is not smaller than the open cross-sectional area of transport line 32. In addition, a distance $W_{AR}$ of the outer surfaces of equalizing tubes 20 should equal at least the absolute value of the width of the slits in filter tube 16 in the location of their greatest proximity in each case, and this distance should preferably be greater than this slit width, e.g., it should assume twice the value thereof. This ensures that solid particles are able to pass between the outer surfaces of equalizing tubes 20 into removal chamber 30 without problems and may be removed via transport line 32. With regard to economic manufacturing costs of apparatus 10, it is suitable for equalizing tubes 20 to each have a circular tube cross-section.

Figure 9:
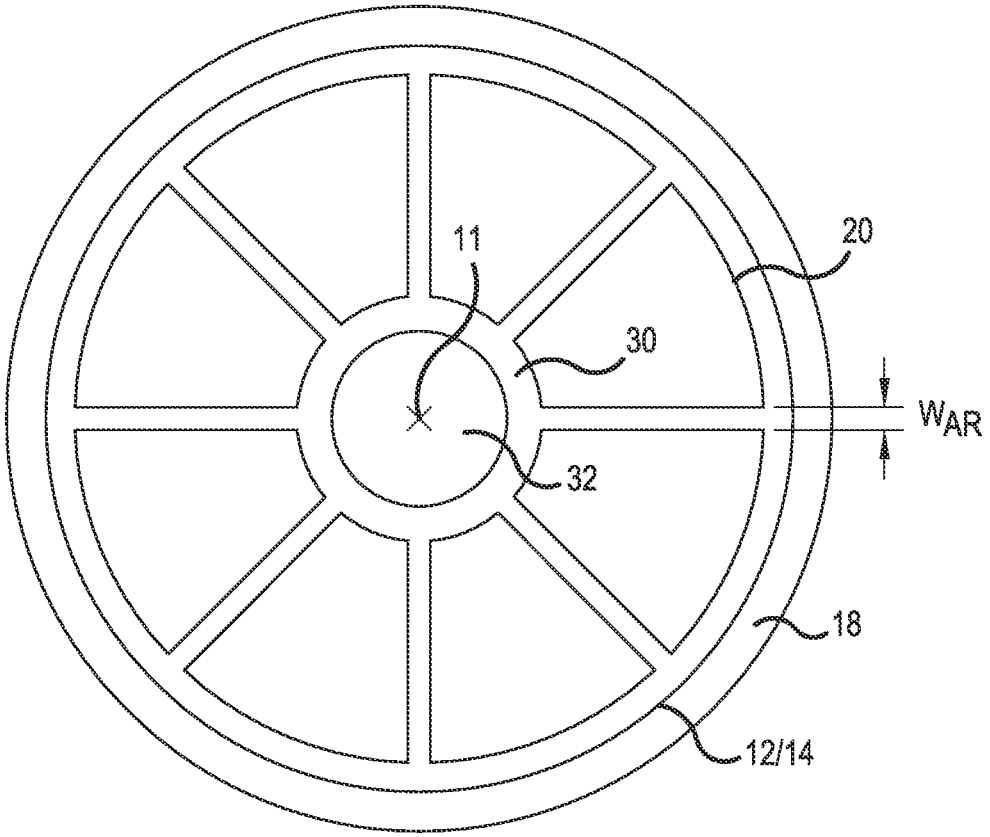
FIG. 9 shows a cross-sectional view of an apparatus according to the invention perpendicular to its longitudinal axis.

FIG. 9 shows a cross-section of equalizing tubes 20, largely perpendicular to longitudinal axis 11 of apparatus 10. In this specific embodiment, the equalizing tubes have a cross-section that is not circular. According to the specific embodiment in FIG. 9, the hydraulic resistance of equalizing tubes 20 may be minimized by maximizing the flow cross-section, the hydraulic radius of the equalizing tubes being taken into account as a form factor in the event of deviations from the circular profile. With their edge surfaces facing the center of removal chamber 30, the equalizing tubes run concentrically to the outer circumference of removal chamber 30 and to the outer circumference of filter tube 16, respectively. Pronounced split flows may arise between the outer surfaces of equalizing tubes 20. To avoid disadvantageously high flow resistances, a gap width $w_{AR}$ between the outer surfaces of the equalizing tubes is recommended which corresponds to several times the absolute value of the slit width of filter tube 16. Deviating from the representation according to FIG. 9, the four edges of each equalizing tube may be provided with a rounded design to further minimize the hydraulic resistance.

Figure 10A:
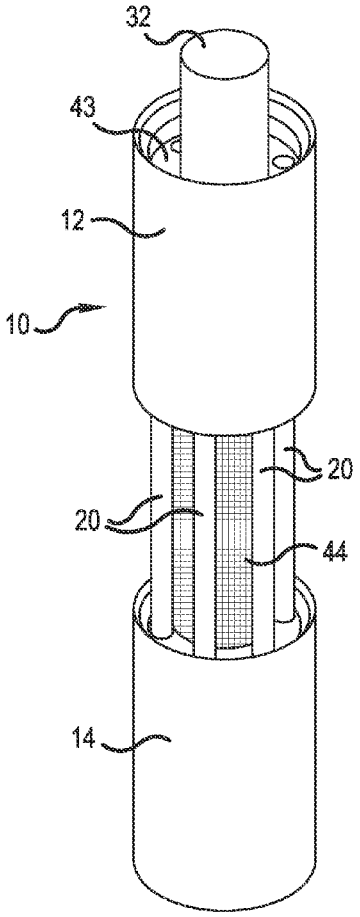
FIG. 10A shows a perspective view of another specific embodiment of an apparatus according to the invention, seen diagonally from above.
Figure 10B:
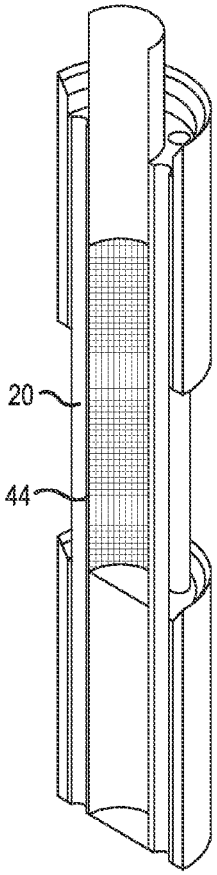
FIG. 10B shows the apparatus from FIG. 10A in a semi-sectional view along the longitudinal axis.
Figure 10C:
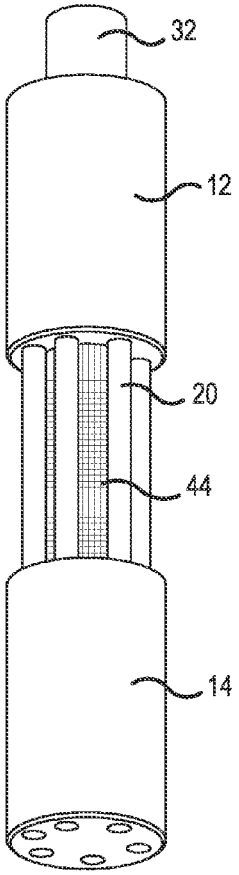
FIG. 10C shows a perspective view of the apparatus from FIG. 10A, seen diagonally from below.

FIGS. 10A, 10B and 10C show another specific embodiment of apparatus 10, namely in a perspective view, seen diagonally from above (FIG. 10A) and diagonally from below (FIG. 10C), FIG. 10B showing a semi-sectional view of the apparatus along its longitudinal axis 11. The same components in comparison to the specific embodiment according to FIG. 6 are provided herein with the same reference numerals and are not explained again to avoid repetition. In contrast to the specific embodiment in FIG. 6, equalizing tubes 20 in the specific embodiment in FIG. 10 have a longer design. In the semi-sectional view according to FIG. 10B, it is apparent that equalizing tubes 20, for the most part, completely penetrate lower second sealing piston 14. Furthermore, equalizing tubes 20 penetrate a part of first sealing piston 12 and empty within this sealing piston in an area adjoining the open outer end face of this sealing piston (apparent in FIG. 10A and FIG. 10B). First sealing piston 12 forms a kind of collecting basin 43 in which the solid particles introduced into filter tube 16 are collected. In the same manner as in the specific embodiment according to FIG. 6, the solid particles are transported down into the well sump through equalizing tubes 20. A perforated tube 44 is situated within removal chamber 30 in a radially inward manner with respect to equalizing tubes 20. A perforated tube 44 of this type is used only to receive water into the removal chamber and thus into transport line 32. Perforated tube 44 may be connected to end plates 22, 24 of sealing pistons 12, 14 at its two axial ends and ensures a secure structural connection between the two sealing pistons 12, 14, in particular when only a small number of equalizing tubes 20 are provided within removal chamber 30. Irrespective of the aforementioned modifications, apparatus 10 in the specific embodiment according to FIGS. 10A through 10C is based on the same functional principle as the specific embodiment explained above, so that full reference is made thereto to avoid repetition.

Figure 11:
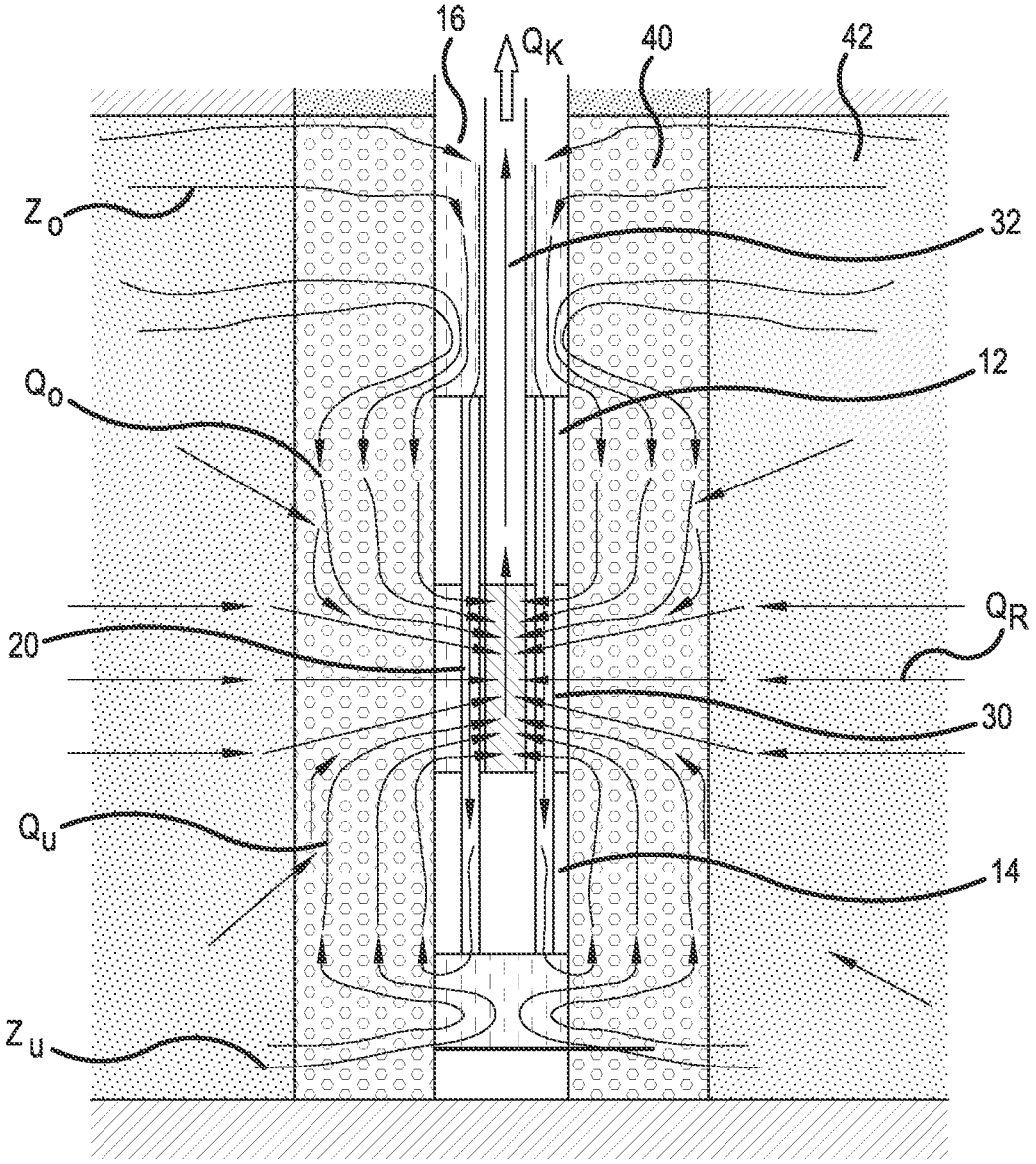
FIG. 11 shows a side sectional view of an apparatus according to the invention shown in FIG. 10, portions of the flow in a filter tube well being illustrated.

FIG. 11 shows an apparatus according to FIG. 10 in a side sectional view along its longitudinal axis, similar to the representation in FIG. 7. FIG. 11 shows a pressure or flow equalization with the aid of equalizing tube 20 for the event that, for example, water volumetric flow $Z_o$ above upper sealing piston 12 is greater than water volumetric flow $Z_u$ below second sealing piston 14, due to different resistances within the ground water conductor in the form of rock 42. Accordingly, a pressure or flow equalization is produced by equalizing tubes 20 in the downward direction, which is accordingly made clear by arrows in FIG. 11. Based on the example of water volumetric flow $Z_o$, it is apparent that this water volumetric flow passes through filter gravel annular chamber 40 and enters filter tube 16 in the radial direction, starting from rock 42, in order to subsequently flow down in the vertical direction to the upper end face of sealing piston 12. A portion of this water volumetric flow $Z_u$ then enters equalizing tubes 20 in order to exit second sealing piston 14 at its lower end face after flowing through these equalizing tubes. This portion of the flow then passes through filter tube 16 and enters annular chamber 40 outwardly in the radial direction over a short distance, in order to flow quickly upward again in the direction of removal chamber 30, before rejoining the other portions of the flow ($Q_R$, $Q_o$, $Q_u$) in the removal chamber. Finally, the low pressure generated by pump device 38 causes the well water to be removed from removal chamber 30 through transport line 32. For the case explained herein, in which water volumetric flow $Z_o$ is greater than water volumetric flow $Z_u$, it is understood that the apparatus in the specific embodiment in FIG. 7 ensures a pressure or flow equalization in the same manner with the aid of equalizing tubes 20. The length of equalizing tubes 20 has no influence thereon.

The invention claimed is:

1. An apparatus for activating or cleaning filter tube wells which have a filter tube, comprising a first volume body and a second volume body, which are adapted to an inner diameter of the filter tube by outer diameters of the first volume body and the second volume body and whose outer circumferential surfaces are designed to be flexible in a radial direction with respect to the a well longitudinal axis, such that a sealing effect exists between the outer circumferential surfaces of the respective volume bodies and an inner wall of the filter tube;

a removal chamber, which is hydraulically connectable to a pump device, the removal chamber being provided between the first and second volume bodies and the inner wall of the filter tube; and at least one equalizing tube which completely penetrates the removal chamber in a longitudinal direction of the apparatus, such that a hydraulic flow is established between outer end faces of the two volume bodies opposite the removal chamber, the equalizing tube equalizing volumetric flow of the first and second volume bodies between the outer end faces.

2. The apparatus according to claim 1, wherein a transport line which is connectable to the pump device empties into the removal chamber.

3. The apparatus according to claim 2, wherein the transport line penetrates the first volume body such that the first volume body surrounds the transport line.

4. The apparatus according to claim 2, wherein the transport line is held within the first volume body by radial supporting ribs.

5. The apparatus according to claim 2, wherein the transport line runs centrically within the first volume body and is oriented coaxially to the centric middle of the removal chamber.

6. The apparatus according to claim 1, wherein the first volume body is open at the outer end face of the first volume body opposite the removal chamber.

7. The apparatus according to claim 6, wherein the equalizing tube runs within the first volume body and ends at a distance from the open end face of the first volume body, such that the first volume body forms a collecting basin from the open end face of the first volume body to an opening in the equalizing tube.

8. The apparatus according to claim 6, wherein the equalizing tube empties into an end plate of the first volume body which adjoins the removal chamber, such that the first volume body forms a collecting basin along an entire length of the first volume body.

9. The apparatus according to claim 1, wherein the equalizing tube penetrates the second volume body.

10. The apparatus according to claim 1, wherein the second volume body opposite the removal chamber is closed by an end plate which has an opening, the equalizing tube emptying into the opening.

11. The apparatus according to claim 1, wherein the second volume body is open on the outer end face of the second volume body opposite the removal chamber.

12. The apparatus according to claim 11, wherein the equalizing tube empties into an end plate of the second volume body adjoining the removal chamber.

13. The apparatus according to claim 1, wherein a plurality of equalizing tubes is provided.

14. The apparatus according to claim 13, wherein a minimum free flow cross-section between the equalizing tubes radially to the longitudinal axis of the apparatus is equal at least to a cross-section of the transport line.

15. The apparatus according to claim 13, wherein the equalizing tubes are situated around the centric middle of the removal chamber, this middle of the removal chamber remaining free.

16. The apparatus according to claim 15, wherein the equalizing tubes have an inner wall and an outer wall, each of which runs concentrically to the inner wall of the filter tube.

17. The apparatus according to claim 13, wherein the equalizing tubes have radially running outer surfaces, a distance of the outer surfaces from equalizing tubes which are adjacent to each other corresponds at least to a slit width of the filter tube.

18. The apparatus according to claim 17, wherein the distance of the outer surfaces from equalizing tubes which are adjacent to each other corresponds at least to twice the value of the slit width of the filter tube.

19. The apparatus according to claim 1, wherein at least one of the first volume body or the second volume body extends longitudinally to the well longitudinal axis.

20. The apparatus according to claim 1, wherein the distance of the two volume bodies relative to each other is adjustable, such that a height of the removal chamber is settable in the direction of the longitudinal axis of the apparatus.

21. The apparatus according to claim 20, wherein at least one of the first volume body or the second volume body is shiftable with respect to the equalizing tube.

22. The apparatus according to claim 21, wherein the first volume body and the second volume body are connected to each other by a tube which is perforated on an outer circumferential surface of the second volume body.

23. The apparatus according to claim 22, wherein the tube completely penetrates the removal chamber in the longitudinal direction of the apparatus.

* * * * *